US005419163A

United States Patent [19]

Kim et al.

[11] Patent Number: 5,419,163

[45] Date of Patent: May 30, 1995

[54] APPARATUS FOR CONTROLLING WASHER

[75] Inventors: Jung H. Kim, Seoul; Hyung S. Kim, Kyungki; Byeong H. Lee, Kyungki; Young H. Roh, Kyungki; Hae Y. Chung, Seoul, all of Rep. of Korea

[73] Assignee: Goldstar Co., Ltd., Seoul, Rep. of Korea

[21] Appl. No.: 133,525

[22] Filed: Oct. 7, 1993

[30] Foreign Application Priority Data

Jun. 19, 1993 [KR] Rep. of Korea ..... 11231/1993

[51] Int. Cl.[6] ..... D06F 33/02

[52] U.S. Cl. ..... 68/12.02; 68/12.04; 68/12.05

[58] Field of Search ..... 68/12.01, 12.02, 12.04, 68/12.05

[56] References Cited

U.S. PATENT DOCUMENTS

| | | | |
|---|---|---|---|
| 4,607,408 | 8/1986 | Didier et al. | 68/12.01 X |
| 5,072,473 | 12/1991 | Thuruta et al. | 68/12.05 X |
| 5,241,845 | 9/1993 | Ishibashi et al. | 68/12.02 |
| 5,297,307 | 3/1994 | Baek | 68/12.02 X |

FOREIGN PATENT DOCUMENTS

| | | | |
|---|---|---|---|
| 9192 | 1/1992 | Japan | 68/12.01 |
| 276294 | 10/1992 | Japan | 68/12.01 |
| 338490 | 11/1992 | Japan | 68/12.01 |

*Primary Examiner*—Philip R. Coe
*Attorney, Agent, or Firm*—Ostrolenk, Faber, Gerb & Soffen

[57] ABSTRACT

A method of and an apparatus for controlling a washer capable of reducing errors of information required to control the washer to precisely control the washer and preventing a malfunction of the washer to improve a reliance of the washer, by analyzing various and complex data, deriving a correlation coefficient of the data according to the result of the analysis, and determining information required to control the washer, based on the correlation coefficient. The control apparatus includes a sensing unit having sensors for outputting data about various operation conditions of the washer such as a water level, a clothes quality and the kind of a detergent, a clothes amount, and a polluted degree of a washing water. A correlation coefficient operating unit is connected to the sensing unit. The correlation coefficient operating unit serves to analyze the data outputted from the sensors so as to operate correlation coefficients of the data. To the correlation coefficient operating unit, a microprocessor is connected which serves to compare each of the correlation coefficients obtained by the correlation coefficient operating unit with corresponding reference data experimentally obtained and determine information required to control the washer, based on the result of the comparison.

2 Claims, 4 Drawing Sheets

APPARATUS FOR CONTROLLING WASHER

BACKGROUND OF THE INVENTION

1. Field of the Invention

The present invention relates to a washer, and more particularly to a method of and an apparatus for controlling a washer, based on an amount of a washing water, a polluted degree of the washing water, an amount of clothes to be washed, a detergent, and etc..

2. Description of the Prior Art

FIG. 1 is a block diagram of a conventional apparatus for controlling a washer. As shown in FIG. 1 , the control apparatus includes a sensing unit 1 having sensors which sense an amount of a water supplied in a washing tub of the washer, a polluted degree of a washing water contained in the washing tub, an amount of clothes to be washed, and a detergent, respectively. A microprocessor 2 is connected to the sensing unit 1. The microprocessor 2 serves to compare data sensed by the sensors of the sensing unit with corresponding reference data and determine various information required to control the washer. Connected to the microprocessor 2 are a drive unit 3 for driving the washer according to the information determined by the microprocessor 2 and a display unit 4 for displaying the currently-controlled condition of the washer.

In the conventional apparatus, data for controlling the washer is generated by each sensor of the sensing unit 1 and sent to the microprocessor 2. The microprocessor 2 analyzes the data by use of an average method, a fuzzy method or a neuro-fuzzy method and compares the result of the analysis with reference data so as to determine information required to control the washer. The determined information is fed to a corresponding one of a motor, a water supply valve, a water drain valve, and a detergent pouring port, via the drive unit 3. Thus the washer is controlled by the information.

In a case of clothes including more various kinds of cloths, data outputted from the sensing unit 1 indicative of a polluted degree of a washing water becomes more complex, as shown in FIG. 2.

In the conventional apparatus, however, it is difficult to accurately determine a desired condition of the washer from the complex data, because information required to control the washer such as a polluted degree, a water level, a clothes amount, a clothes quality, or the kind of a detergent is determined from the result obtained by comparing the result obtained by operating the data simply inputted without any processing with reference data experimentally obtained. Where sensed data contains a noise, the determination of the desired condition of washer based on the data may be erroneously made. As a result, the washer may operate erroneously.

In accordance with the conventional apparatus, it is also difficult to achieve a quantification of data indicative of various operation conditions of washer such as a water flow, a clothes quality, a clothes amount, and etc.. Consequently, the result obtained by the comparison of the data with reference data may involve a considerable error. This makes it difficult to precisely control the washer.

SUMMARY OF THE INVENTION

Therefore, an object of the invention is to provide a method of and an apparatus for controlling a washer capable of reducing errors of information required to control the washer, precisely controlling the washer and improving a reliance of the washer, by analyzing data supplied from various sensors, deriving a correlation coefficient of the data according to the result of the analysis, comparing the correlation coefficient with reference data, and determining various information required to control the washer according to the result of the comparison.

In accordance with one aspect, the present invention provides an apparatus for controlling a washer comprising: sensing means for sensing a plurality of sensors for sensing various operation conditions of said washer; correlation coefficient operating means for analyzing data outputted from said sensing means and deriving correlation coefficients of said data; and a microprocessor for comparing each of said correlation coefficients supplied from said correlation coefficient operating means with corresponding reference data experimentally obtained and determining various information required to control the washer, based on the result of said comparison.

In accordance with another aspect, the present invention provides a method for controlling a washer comprising the steps of: (a) reading data supplied from sensing means equipped in said washer and deriving a predetermined number of vectors from said data; (b) selecting a reference vector from said vectors derived at said step (a) and operating a distance between said reference data and other data; (c) determining the vectors as having a correlation when said distance derived at said step (b) is less than a predetermined distance index, counting the number of correlated vectors, and normalizing the counted number of correlated vectors by a predetermined maximum value and a predetermined minimum value, and incrementing said distance index; (d) depicting a graph having a X-axis indicative of the distance index and a Y-axis indicative of the counted number of correlated vectors, determining appropriate inflection points of said graph, calculating a slope of a line connecting said inflection points, and outputting said slope as a correlation coefficient of the data; and (e) comparing said correlation coefficient calculated at said step (d) with reference data previously stored and determining information required to control the washer, based on the result of said comparison.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
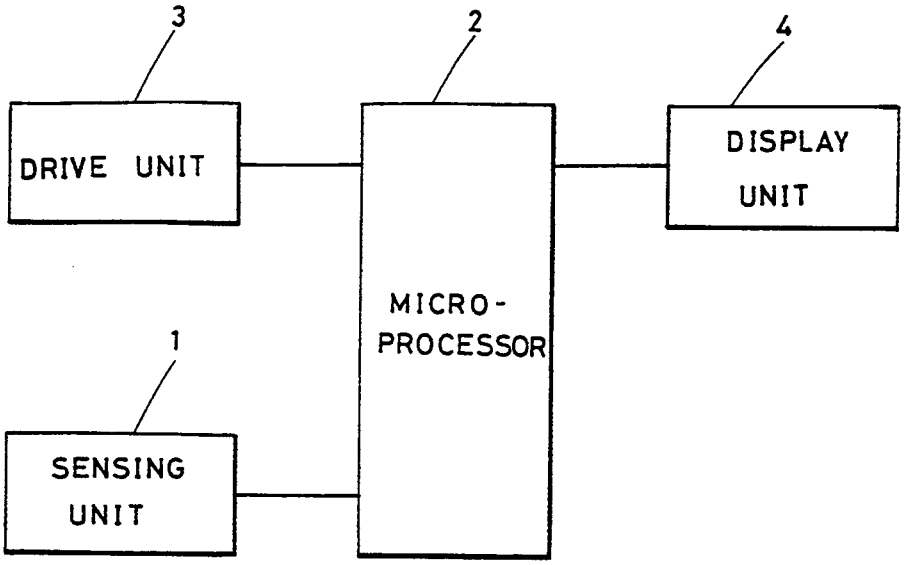
FIG. 1 PRIOR ART
FIG. 1 is a block diagram of a conventional apparatus for controlling a washer.
Figure 2:
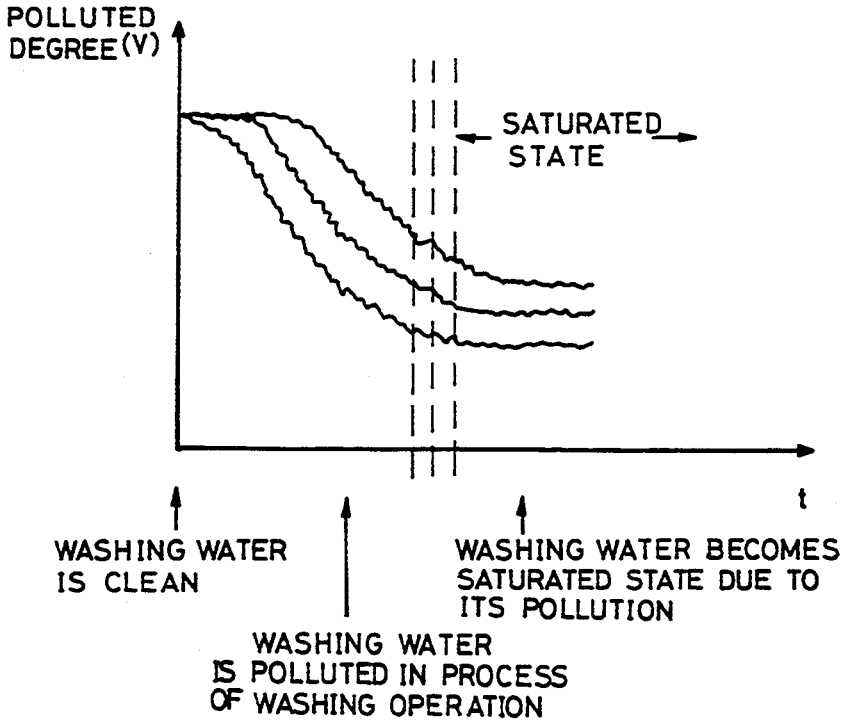
FIG. 2 PRIOR ART
FIG. 2 is a graph illustrating a polluted degree of a washing water in a conventional washer.
Figure 3:
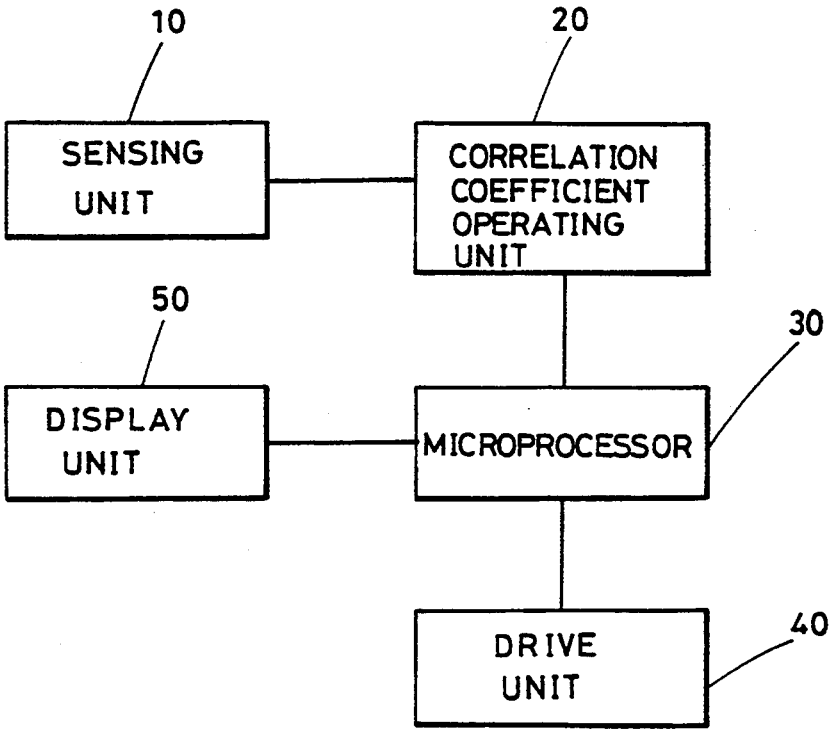
FIG. 3 is a block diagram illustrating an apparatus for controlling a washer in accordance with the present invention.

FIG. 3 is a block diagram illustrating an apparatus for controlling a washer in accordance with the present invention.

As shown in FIG. 3, the control apparatus includes a sensing unit 10 having sensors for outputting data about various operation conditions of the washer such as a water level, a clothes quality and the kind of a detergent, a clothes amount, and a polluted degree of a washing water. A correlation coefficient operating unit 20 is connected to the sensing unit 10. The correlation coefficient operating unit 20 serves to analyze the data outputted from the sensors so as to operate correlation coefficients of the data. To the correlation coefficient operating unit 20, a microprocessor 30 is connected which serves to compare each of the correlation coefficients obtained by the correlation coefficient operating unit 20 with corresponding reference data experimentally obtained and determine information required to control the washer, based on the result of the comparison. Connected to the microprocessor 30 are a drive unit 40 for driving the washer, based on the information determined by the microprocessor 30 according to an operation mode selected by a user and a display unit 50 for displaying the currently-controlled condition of the washer which operates in the selected mode.

The sensing unit 10 outputs to the correlation coefficient operating unit 20 various sensed data such as turbidity (A(t)), water level (B(t)), kinds of clothes (C(t)), amount of clothes (D(t)), and volume of detergent (E(t)), whose values vary with respect to time. A set of data at time tn is expressed as {A(tn), B(tn), C(tn), D(tn), E(tn)} and their respective correlation coefficients (Ax, Bx, Cx, Dx, Ex) are calculated to be inputted to the microprocessor 30. In the microprocessor 30, correspondent data to the inputted correlation coefficients are selected from stored data and outputted to the drive unit 40 and the display unit 50 for a proper pattern of washing operation. The data stored are decided compositely through experiments on turbidity, kinds of clothes, amount of clothes, and volume of detergent.

Figure 4:
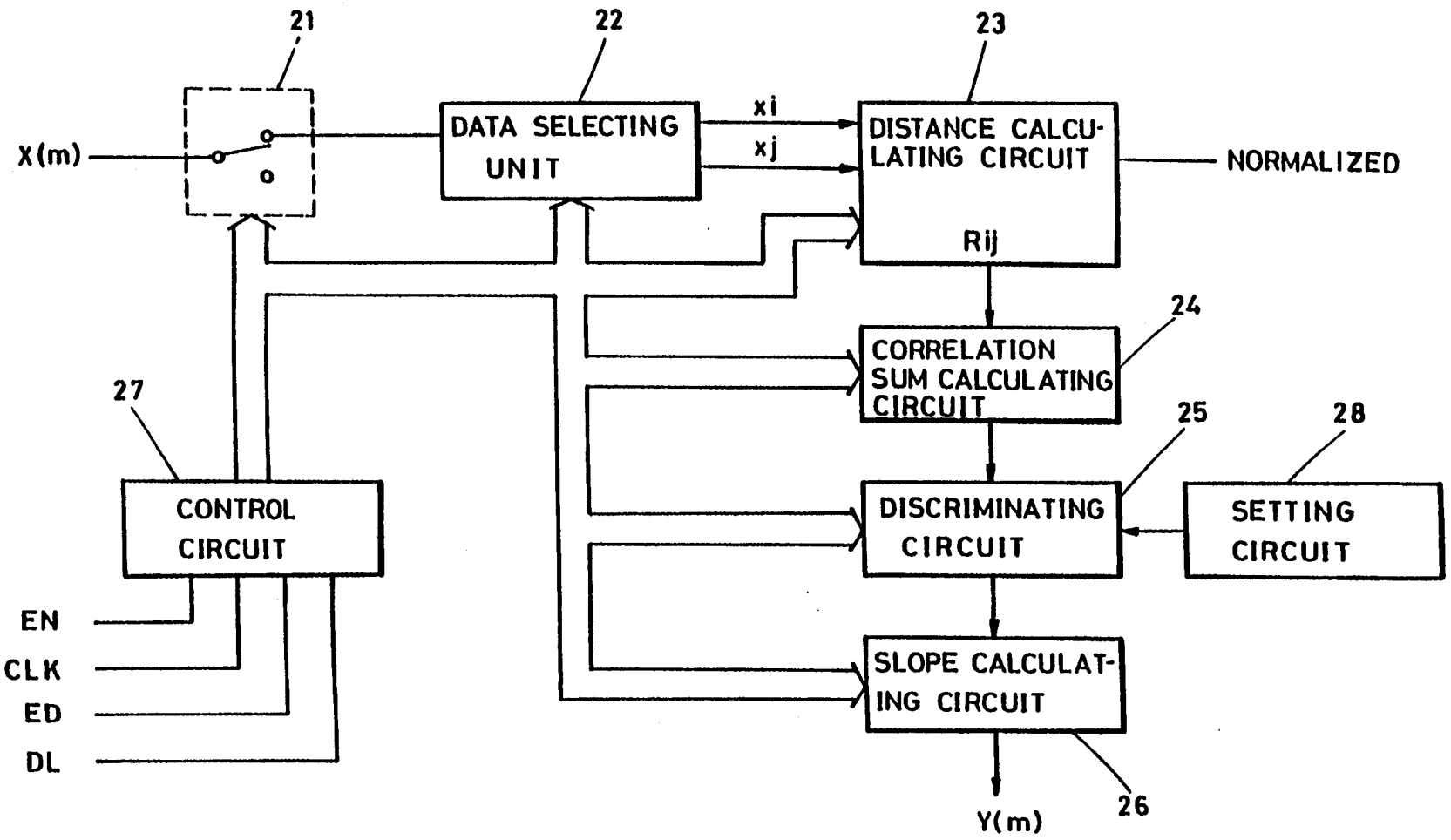
FIG. 4 is a block diagram of a correlation coefficient operating unit equipped in the control apparatus according to the present invention.

As shown in FIG. 4, the correlation coefficient operating unit 20 comprises a switching circuit 21 adapted to switch data X(m), which are to be analyzed, sequentially with the lapse of time and to output them, a data selecting circuit 22 adapted to derive vectors of the data outputted from the switching circuit 21 and select desired vectors from the derived vectors, based on an embedding dimension ED and a delay time DL, and a distance calculating circuit 23 adapted to calculate a distance Rij, based on two vectors Xi and Xj selected in the data selecting circuit 22 and to output the distance Rij. A correlation sum calculating circuit 24 is also provided, which is adapted to compare the distance Rij outputted from the distance calculating circuit 23 with a distance index di previously stored and output a correlation sum C(r) corresponding to the distance index which meets a given distance condition. The correlation coefficient operating unit 20 also comprises an inflection point discriminating circuit 25 adapted to discriminate appreciate inflection points of the correlation sum C(r) outputted from the correlation sum calculating circuit 24, a slope calculating circuit 26 adapted to calculate a slope of a line connecting the inflection points outputted from the inflection point discriminating circuit 25 and output a correlation coefficient Y(m), and a control circuit 27 adapted to output control signals for controlling the switching circuit 21, the data selecting circuit 22, the distance calculating circuit 23, the correlation sum calculating circuit 24 and the discriminating circuit 25, based on an input clock CLK, an enable signal EN, the embedding dimension ED and the delay time DL.

The data selecting circuit 22 includes a pair of registers. A setting circuit 28 is connected to the other input of the discriminating circuit 25, so as to input an optimum inflection point from outside at the discriminating circuit 25.

Figure 5:
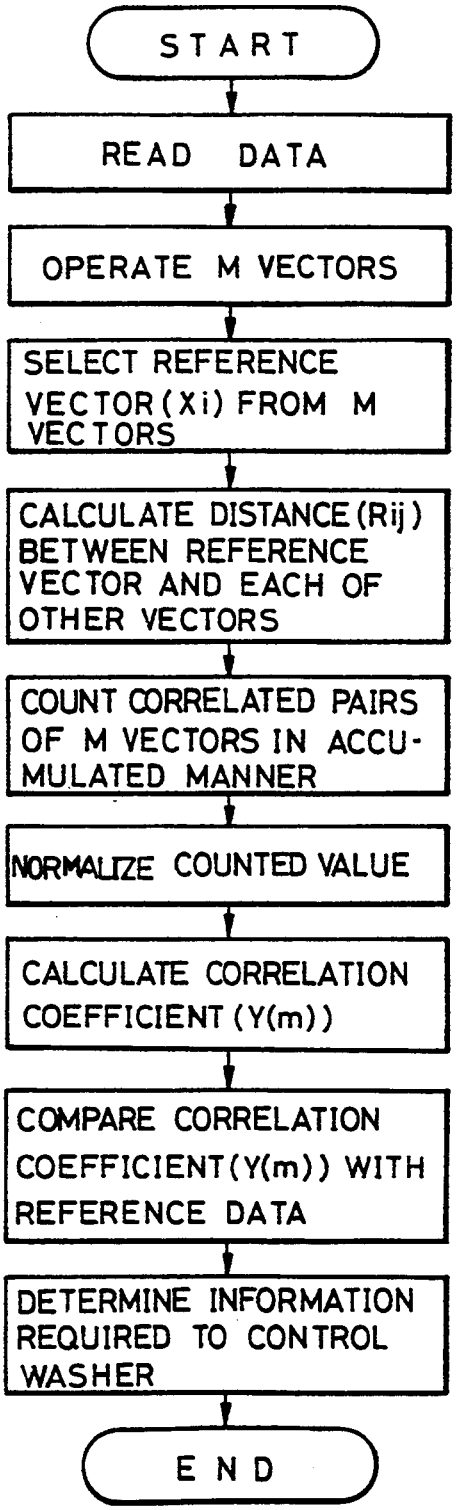
FIG. 5 is a flow chart illustrating a method for controlling a washer in accordance with the present invention.

FIG. 5 is a flow chart illustrating a method for controlling a washer in accordance with the present invention.

As shown in FIG. 5, the washing controlling method comprises a first procedure of reading data X(m) supplied from the sensing unit 10 and deriving a predetermined number of vectors from the data X(m), and a second procedure of selecting a reference vector Xi from the M vectors derived at the first procedure and operating a distance Rij between the reference data Xi and other data Xj. The method further comprises a third procedure of determining the vectors Xi and Xj as having a correlation when the distance Rij derived at the second procedure is less than a predetermined distance index di, counting the number of correlated vectors Ndi, and normalizing the counted number of correlated vectors Ndi by a predetermined maximum value Dmax and a predetermined minimum value Dmin, and incrementing the distance index di, a fourth procedure of depicting a graph having a X-axis indicative of the distance index di and a Y-axis indicative of the counted number Ndi, determining appropriate inflection points of the graph, calculating a slope of a line connecting the inflection points, and outputting the calculated slope as the correlation coefficient, of the data, and a fifth procedure of comparing the correlation coefficient calculated at, the fourth procedure with reference data previously stored and determining information required to control the washer according to the result of the comparison.

Functions and effects of the washer controlling apparatus and method will now be described, in conjunction with FIGS. 3 to 5.

When a washing mode is selected after clothes 1 to be washed have been poured in a washing tub of a washer, a corresponding mode signal is applied to the microprocessor 30 which, in turn, outputs a control signal for accomplishing the selected washing mode.

The control signal is fed to the drive unit 40 so that a water supply valve is controlled to supply a washing water in the washing tub. The drive unit 40 also drives a motor. The drive force of the motor is transmitted to an agitator of the washer, thereby causing the agitator to rotate normally and reversely. Thus the washer starts to carry out its washing operation. In similar manner, controls for overall operations of the washer such as a water supplying operation, a water draining operation, a rinsing operation and a dehydrating operation are carried out.

During such operations, the sensing unit 10 outputs data indicative of a water level in the washing tub, an amount of clothes to be washed, the kind of a detergent, a quality of clothes, and a polluted degree of a washing water.

Where the clothes to be washed include more various kinds of cloths, the data outputted from the sensing unit 10 becomes more complex. Such complex data is applied to the correlation coefficient operating unit 20 so as to derive a correlation coefficient thereof.

For deriving the correlation coefficient of the data, first, desired data X(m) is sequentially selected, based on a given embedding dimension ED and a delay time DL.

This procedure will be described in conjunction with an example of an embedding dimension ED=1 and a delay time DL $=\tau=\Delta t$.

Input data X(m) is applied to the data selecting circuit 22 through the switching circuit 21 which performs its switching operation according to a control signal from the control circuit 27.

Assuming that an initial value of the inputted data X(m) is X(t0), the initial value X(t0) is fed to the data selecting circuit 22 through the switching circuit 21. Data values which are continuously inputted at every delay time $\tau$ are applied to the data selecting circuit 22 through the switching circuit 21.

Namely, the initial value X(t0) is first inputted at the data selecting circuit 22. Then, the data selecting circuit. 22 receives a data value $X(t0+\Delta t)$ at the delay time $t0+\Delta t$. The data values X(t0) and $X(t0+\Delta t)$ are then applied to the distance calculating circuit 23 according to a control signal from the control circuit 27.

The distance calculating circuit 28 stores the inputted data values X(t0) and $X(t0+\Delta t)$ in its registers, respectively, for a predetermined time and then outputs them with the lapse of time.

With the outputted data values X(t0) and $X(t0+\Delta t)$, the distance calculating circuit 23 calculates a distance R11 between the two data values X(t0) and $X(t0+\Delta t)$. At this time, the embedding dimension ED is 1 and the delay time $\tau$ is $\Delta t$. Accordingly, the distance R11 can be obtained from an operation using the following equation (1):

$$R11=|X(t0)-X(t0+\Delta t)| \quad (1)$$

The calculated distance R11 is outputted under a condition that it has been normalized by a maximum value Dmax, a minimum value Drain, and other values, all of the values being optionally predetermined.

The distance R11 is then applied to the correlation sum calculating circuit 24 which, in turn, compares the inputted distance R11 with the previously stored distance index di and increments the distance index di by one when the condition of R11>di is satisfied, to obtain an incremented distance index dj.

Namely, the incremented di stance index dj satisfies the following equation (2):

$$dj=di+1 \quad (2)$$

The above procedure is performed for the delay time $\Delta t$. The switching circuit 21 supplies a data value $X(t0+2\Delta t)$ received therein at the next delay time $2\Delta t$. Based on the inputted data value $X(t0+2\Delta t)$ and the initial data value X(t0), the distance calculating circuit 23 outputs a distance R12 between the two data values.

The outputted distance R12 is compared with the previously stored distance index dj through the correlation sum calculating circuit 24. When the compared result satisfies the condition of R12>dj, the distance index dj is incremented.

The above procedures are repeated with respect to all data values received with the lapse of delay time. When the number of data Ndj present in a circle having a diameter corresponding to the incremented distance index reaches the predetermined final number Dmax, no input data is applied to the data selecting circuit 22 via the switching circuit 21.

Namely, in such a case that the number of data Ndj present in the circle having the diameter which corresponds to the distance index dj has been determined to reach the final number Dmax through the correlation sum calculating circuit 24, a control signal is supplied from the control circuit 27 to the switching circuit 21 so that the switching circuit 21 performs its switching operation. By the switching operation of switching circuit 21, the supplying of data to the data selecting circuit 22 is shut off.

In the mean while, the discriminating circuit 25 receives a control signal from the control circuit 27 and selects the distance indexes di and dj having an appreciate inflection point in a graph which represents the number of data Ndj present in the circle having the diameter corresponding to the inputted distance index.

The inflection point may be selected from the distance indexes di and dj previously set in the discriminating circuit 25. Otherwise, the user may set the inflection point through the setting circuit 28 at outside.

Where distance indexes have been previously set through the discriminating circuit 25, in order to derive the inflection point, a distance index is selected from optional distance indexes di and dj. A search is made for a distance index which satisfies the minimum distance from a line connecting the selected distance index and the other distance index. Once the distance index is found, a procedure for setting the found distance index as the inflection point is performed to determine an appreciate inflection point. Where the distance index is determined by the setting circuit 28, an optimum inflection point derived experimentally is determined from outside.

The inflection point determined as above is fed to the slope calculating circuit 26. Where an X-Y coordinate plane is made by a d-axis indicative of the distance index and a Nd-axis indicative of the number of data present in a circle with a diameter equivalent to the distance index, the slope calculating circuit 26 calculates a slope resulted from the incremented number of data.

At this time, the slope is calculated by using the following equation (3):

$$\text{Slope}=[\log(Ndj)-\log(Ndi)]/[\log(dj)-\log(di)] \quad (3)$$

The calculated slope is the correlation coefficient of the data, namely, a final output Y(1) of the correlation coefficient operating unit 20.

The correlation coefficient of the data, which is obtained on the assumption that the embedding dimension ED is 1, and the delay time DL is $\Delta t$, refers to as a correlation coefficient according to a pointwise method.

Where the embedding dimension ED and the delay time DL ($DL=\tau$) are assumed as m and $t\Delta p$, respectively, the data selecting circuit 22 outputs data values Xi at the time t0 in the form of vectors through the switching circuit 21 for the time $(m-1)p\Delta t$.

The vectors can be expressed by the following equation:

$$Xi=[X(t0), X(t0+p\Delta t), \ldots, X(t0+(m-1)p\Delta t)]$$

Also, the data values Xj at the time $t0+\Delta t$ can be expressed in the form of vectors by the following equation:

$$Xj=[X(t0+\Delta t), X(t0+(p+1)\Delta t), \ldots X(t0+mp\Delta t)]$$

In this case, the vectors Xi are selected as reference vectors. A distance value Rij calculated from the above vectors Xi and Xj is $|Xj-Xi|$. Based on the calculated distance, the correlation dimension Y(m) of the data supplied from the sensing unit 10 can be obtained through the correlation calculating circuit 24, the discriminating circuit 25, the slope calculating circuit 26, and the control circuit 27.

Each of correlation coefficients supplied from the correlation coefficient operating unit 20 is compared with the reference data experimentally obtained, in the microprocessor 30. Based on the result of the comparison, the microprocessor 30 determines information required to control the washer such as a washing time, an amount of a detergent to be used, and an intensity of a water flow so that it controls the water supply valve, the water drain valve and the motor according to the determined information.

As apparent from the above description, the present invention provides a method of and an apparatus for controlling a washer capable of reducing errors of information required to control the washer to precisely control the washer and preventing a malfunction of the washer to improve a reliance of the washer, by analyzing various and complex data, deriving a correlation coefficient of the data according to the result of the analysis, and determining information required to control the washer, based on the correlation coefficient.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for controlling a washer comprising:

sensing means for sensing a plurality of operation conditions of said washer;

correlation coefficient operating means for analyzing data outputted from said sensing means and deriving correlation coefficients of said data; and a microprocessor for comparing each of said correlation coefficients supplied from said correlation coefficient operating means with corresponding reference data experimentally obtained and determining various information required to control washing time and operation of other operating conditions of the washer, based on the result of said comparison.

2. Apparatus in accordance with claim 1, wherein the correlation coefficient operating means includes:

a switching circuit for switching the data to be analyzed;

a data selecting circuit for receiving data from the switching circuit, for deriving vectors of such data and for selecting desired vectors from the derived vectors;

a distance calculating circuit for calculating a distance Rij based on the selected vectors;

a correlation sum calculating circuit for receiving the distance Rij, comparing the distance Rij with a distance index di and for outputting a correlation sum C(r) corresponding to the distance index di which meets a given distance condition;

inflection point discriminating circuit for discriminating appreciable inflection points of the correlation sum C(r); and a slope calculating circuit for calculating the slope of a line connecting the inflection points outputted from the inflection point discriminating circuit and outputting a correlation coefficient.

* * * * *